United States Patent [19]

Malsby et al.

[11] 4,090,764

[45] May 23, 1978

[54] MODULAR ELECTRICAL CONNECTOR

[75] Inventors: Marc W. Malsby, Lake Arrowhead; Norman W. Willey, Yucaipa, both of Calif.

[73] Assignee: The Deutsch Company Electronic Components Division, Banning, Calif.

[21] Appl. No.: 572,111

[22] Filed: Apr. 28, 1975

Related U.S. Application Data

[63] Continuation of Ser. No. 426,434, Dec. 19, 1973, abandoned.

[51] Int. Cl.[2] ..... H01R 9/16; H01R 13/58

[52] U.S. Cl. ..... 339/103 M; 339/198 GA; 339/222

[58] Field of Search ..... 339/198 R, 198 P, 198 G, 339/198 GA, 59 M, 94 M, 94 R, 153, 154 R, 154 A, 156 R, 103 R, 103 M, 258 P, 19, 177 R, 222

[56] References Cited

U.S. PATENT DOCUMENTS

| | | | |
|---|---|---|---|
| 2,968,782 | 1/1961 | Herrmann et al. | 339/103 M X |
| 3,042,895 | 7/1962 | Bonhomme | 339/156 R X |
| 3,160,280 | 12/1964 | Burch | 339/198 GA X |
| 3,358,264 | 12/1967 | Brejcha | 339/177 R |
| 3,547,274 | 12/1970 | Sosinski | 339/198 GA X |
| 3,559,813 | 2/1971 | Sosinski | 339/198 GA X |
| 3,576,520 | 4/1971 | Stauffer | 339/198 G |
| 3,594,714 | 7/1971 | Paullus et al. | 339/258 P X |
| 3,597,726 | 8/1971 | Appleton | 339/198 P |
| 3,727,172 | 4/1973 | Clark | 339/59 M |
| 3,740,693 | 6/1973 | Gorman | 339/19 |

FOREIGN PATENT DOCUMENTS

| | | | |
|---|---|---|---|
| 1,565,673 | 3/1967 | France | 339/19 |

OTHER PUBLICATIONS

Martin, G. H., *Connector Block Strain Relief Devices*, in I.B.M. Technical Disclosure, vol. 3, No. 6 : pp. 2–3, Nov., 1960.

*Primary Examiner*—Howard N. Goldberg
*Attorney, Agent, or Firm*—Gausewitz, Carr & Rothenberg

[57] ABSTRACT

An electrical connector arrangement including individual modules which may be assembled in a side-by-side relationship in a supporting device having spaced, opposed, inwardly inclined resilient spring fingers engageable with shoulders on the modules for holding them in place, each module including a dielectric body having cavities therein within which are pin contacts that enter socket contacts at the ends of wires inserted into the cavities. An optional lateral wire support attachment has flanges fitting within grooves in the sides of the modules. The modules are removable from the support rail by a bifurcated tool which pries the resilient fingers outwardly to free the modules, the same tool being usable to deflect the flanges of the wire support away from the grooves and allow removal of that component.

10 Claims, 19 Drawing Figures

FIG. 7.
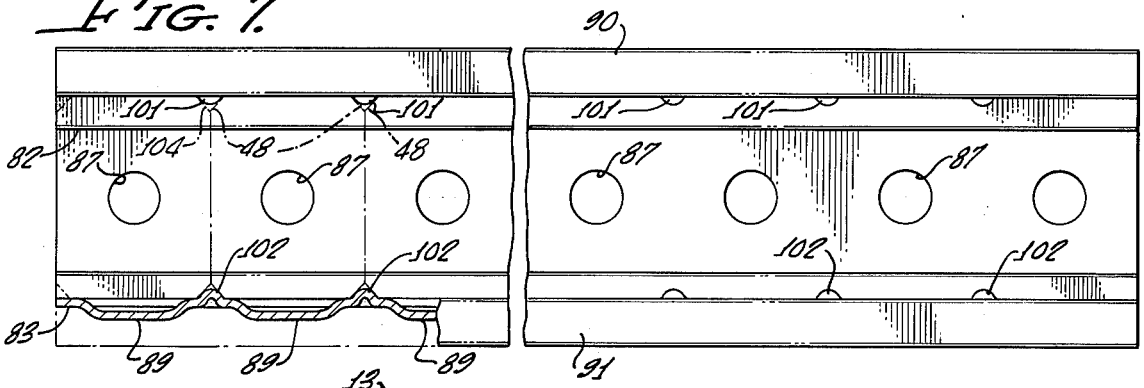
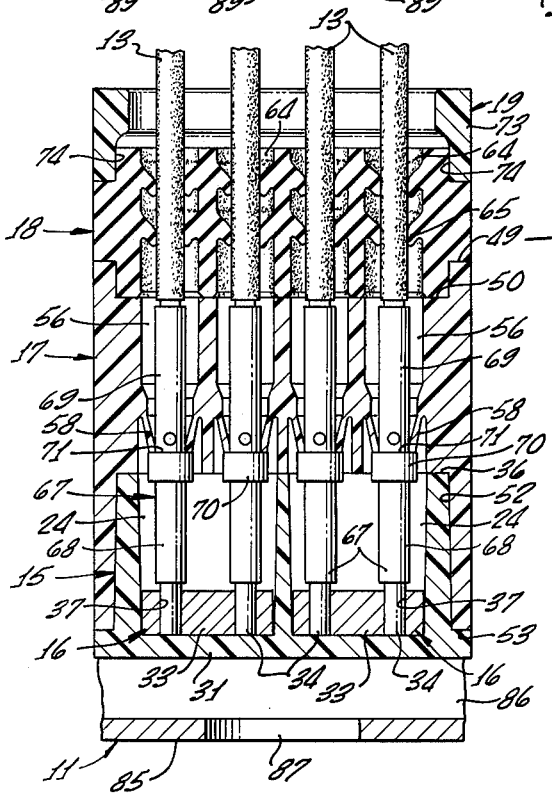
FIG. 5.
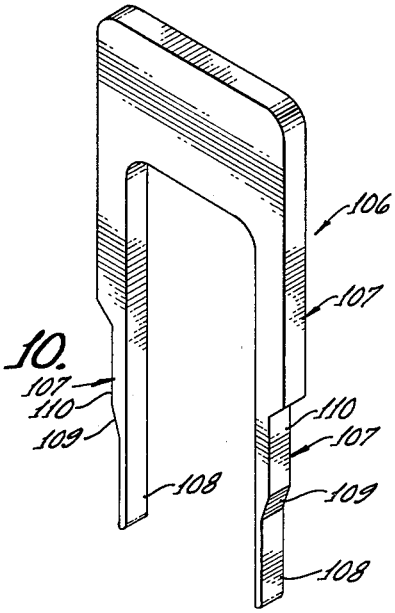
FIG. 10.
FIG. 13.
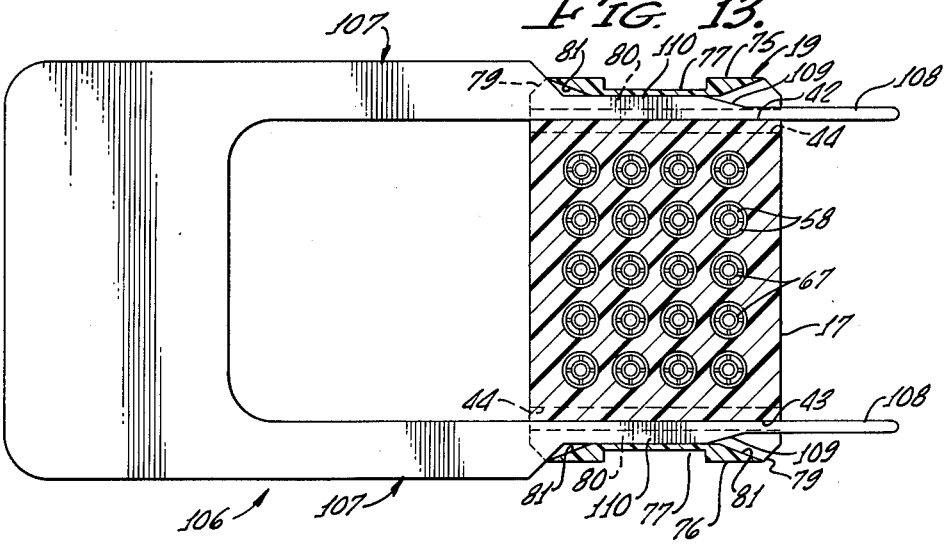

MODULAR ELECTRICAL CONNECTOR

CROSS-REFERENCE TO RELATED APPLICATIONS:

This is a continuation of application Ser. No. 426,434, filed Dec. 19, 1973, for MODULAR ELECTRICAL CONNECTOR, by Marc W. Malsby and Norman W. Willey, which application has become abandoned as of the filing date accorded this application.

BACKGROUND OF THE INVENTION

1. Field of the Invention

This invention pertains to an electrical connector.

2. Description of Prior Art

Electrical connectors normally are made as individual components which are not adapted for compact grouping. Each connector has its own mounting arrangement, which ordinarily does not cooperate with the mounting for any other connector. There has been a variation in the overall dimensions of prior connectors for accommodating contacts of different sizes, and there has been a general lack of standardization of components. In summary, the prior art has been devoid of a suitable simplified arrangement for modular assemblies of electrical connectors.

SUMMARY OF THE INVENTION

The present invention provides an electrical connector arrangement made up of individual interchangeable modules which may be readily assembled in desired numbers. The same support is used for modules containing contacts of different sizes. Modules may be made up of housings of dielectric material having cavities within which are pin contacts. Thus, in all instances, socket contacts are supplied at the ends of the wires entering the connector modules. Within the modules, rear-release contact retention systems are used in holding the socket contacts in place.

The module support may include an elongated channel which, at predetermined spaced positions along its length, is provided with opposed, inwardly inclined resilient spring fingers. The latter elements fit behind shoulders in the sides of the various modules positioned in the channel to hold the modules to the channel. The spring fingers are formed from strips of material positioned along the sides of the channels and held in place by flanges on the channels. Module insertion requires no tools, and is accomplished merely by pushing the modules into the channels, which causes the spring fingers to assume their positions behind the shoulders . Module removal is accomplished by a simple tool which has a bifurcated end which pries the spring fingers away from the shoulders to free the modules.

An optional wire support has flanges to fit in grooves in the sides of the modules, with an upper portion encircling the wires entering the module to provide lateral reinforcement. The wire support is removable from the module by the same tool that effects the removal of the modules from the channel, which displaces the flanges of the wire support from the module grooves. The modules may be varied in purpose without sacrificing the standardization and simplicity inherent in their design. Typically, each module is a feedback unit containing a number of buses which carry the pin contacts and electrically interconnect selected ones of these contacts. Feedthrough designs also are provided.

BRIEF DESCRIPTION OF THE DRAWING

FIG. 5 is a sectional view taken along line 5—5 of FIG. 4;

FIG. 7 is a top plan view, partially broken away, of the support channel;

FIG. 10 is a perspective view of the tool for removal of the modules from their support and the wire supports from the modules;

FIG. 13 is a sectional view illustrating the removal of the wire support by the tool;

DESCRIPTION OF THE PREFERRED EMBODIMENTS

Figure 1:
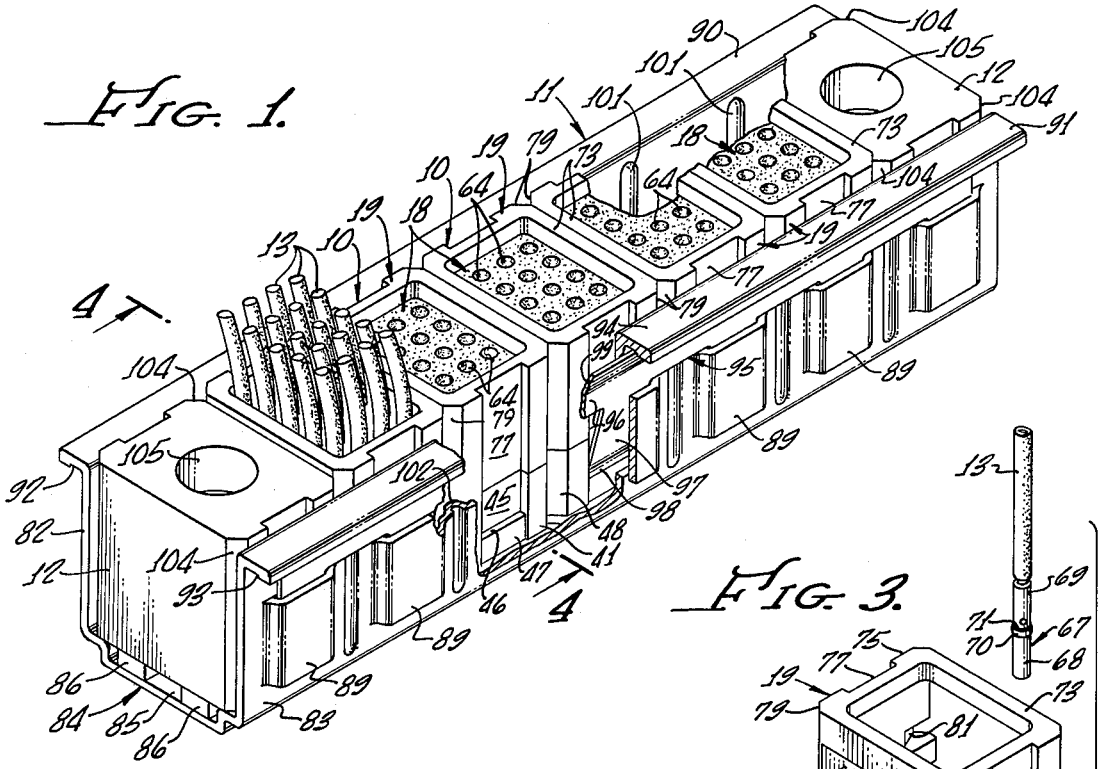
FIG. 1 is a perspective view, partially broken away, of the modular electrical connector assembly of this invention.

As illustrated in FIG. 1, the arrangement of this invention includes a number of feedback modules 10 held in a row in side-by-side relationship in a support channel 11. End blocks 12 are at the ends of the row of modules 10. Five modules 10 are held in the channel 11 shown in FIG. 1, but the channel may be made longer or shorter to accommodate a different number. Wires 13 enter the modules 10 for making electrical connections, as explained below.

Figure 3:
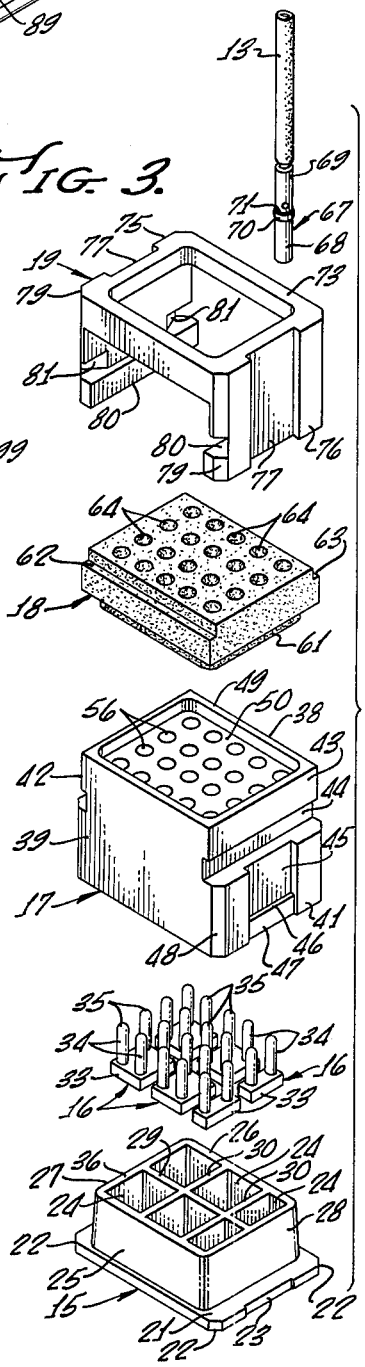
FIG. 3 is an exploded perspective view of a module.

Each module 10, one of which is shown in exploded form in FIG. 3, includes a lower housing section 15, a plurality of bus assemblies 16, a principal housing section 17, a grommet 18 and a wire support 19.

The lower housing section 15, which is made of a suitable dielectric material such as a rigid plastic, includes a base flange 21, which has beveled corners 22 and is wider at the ends of the housing than along its sides. A shallow central recess 23 is in each of the end portions of the flange 21. The housing section 15 includes a plurality of upwardly facing chambers 24 dimensioned to receive the bus assemblies 16. The chambers 24 are defined by the sidewalls 25 and 26 and the end walls 27 and 28 of the housing 15, as well as longitudinal and transverse partitions 29 and 30, respectively. The chambers 24 are open at their tops, but their bottom ends are closed by the bottom wall 31 of the housing section 15.

In the embodiment illustrated in FIGS. 1–6, there are six bus assemblies 16, each including a flat bus plate 33 and contact pins 34, the latter being of equal length and rounded at their upper ends 35. Four of the bus assemblies 16 have four contact pins each, while the remaining two have two contact pins. This relationship may vary to suit conditions to provide a desired number of contact pins on the various bus assemblies. These assemblies are not limited to a maximum of four contact pins, but may have a greater number, in which event the chambers 24 will be made correspondingly larger.

The bus assemblies 16 received in the chambers 24 in the lower housing section 15 are separated by the longitudinal and transverse partitions 29 and 30 which form dielectric barriers. In the embodiment illustrated, there are four larger chambers 24 of square shape to receive the larger bus assemblies 16 which have four contact pins 34. The remaining two rectangular, narrower chambers 24 receive the smaller bus assemblies 16 with two contact pins each. The bus assemblies 16 are supported on the bottom wall 31 of the housing section 15, held to the housing by sonic welding, with the contact pins extending upwardly in a parallel relationship. The contact pins 34 are shorter than the height of the chambers 24 so that the upper ends 35 of the pins are beneath the upper edge 36 of the lower housing section 15. The contact pins 34 are secured to the bus plates 33 by fitting them into openings 37 through the bus plates. There is a force fit between each pin 34 and the wall of the opening 37 that receives it, so that the pin is securely held in place and forms a good electrical connection with the plate 33.

The principal housing section 17 also is made of dielectric material, typically a rigid plastic. It is rectangular in shape, including flat sidewalls 39 and 40. The opposite ends of the housing 17 include flat lower walls 40 and 41 above which are upper walls 42 and 43 respectively, which are set inwardly of the lower walls. Between the upper and lower walls 40 and 42, and 41 and 43, are transverse grooves 44, which are parallel to the top and bottom surfaces of the housing 17. Below the grooves 44, central vertical recesses 45 are provided in the lower end walls 40 and 41, these recesses being not as deep as the transverse grooves 44. Flat transverse shoulders 46, parallel to the grooves 44, connect the vertical recesses 45 to shallower recesses 47 that extend to the bottom of the housing 17 and correspond in dimension and position to the recesses 23 in the flange 21 of the lower housing section 15.

The lower end walls 40 and 41 connect to the sidewalls 39 and 40 through beveled corners 48.

The upper edge 49 of the housing 17 forms a narrow border around a central recessed upper surface 50 which is parallel to it.

A generally comparable but considerably deeper recess 52 is provided in the bottom wall 53 of the housing 17. There is a transverse wall 54, parallel to the top and bottom walls 50 and 53, at the inner end of the recess 52.

When the housings 15 and 17 are assembled, the bottom surface 53 of the housing 17 is superimposed on the flange 21 of the lower housing 15, being coterminous with the flange. The remainder of the lower housing 15 fits within the recess 52 in the bottom portion of the principal housing section 17, and the upper end 36 of the lower housing 15 is sonic-welded or otherwise secured to the inner wall 54 of the recess 52.

Parallel openings 56 extend through the housing 17 from the upper recessed wall 50 to the wall 54 at the inner end of the recess 52. These openings are equal in number to the contact pins 34 and are aligned with these pins.

A rear-release electrical contact retention system is included in the openings 56, and may include integral plastic retention fingers of the type shown and described in U.S. Pat. No. 3,727,172, which is hereby incorporated by reference. In the design shown, each opening 56 is provided with four retention fingers 58 which incline inwardly from the wall of the opening and forwardly toward the surface 54 of the housing. The fingers 58 are formed generally as conic sections, in the example shown, with free forward ends.

The grommet 18 is made of resilient rubber and has a rectangular lower portion 61 of reduced length and width, dimensioned to fit within the recessed upper end of the housing 17 for engagement with the central upper wall 50 of the housing, to which it is secured. Longitudinal recesses 62 and 63 provide flat shoulders at the upper corners of the opposite sides of the grommet. Extending through the grommet are openings 64 which register with the openings 56 in the housing 17 and are equal in number to the openings 56. Deflectable annular sealing ridges 65 are included in the openings 64.

Socket contacts 67 of conventional configuration are secured to the ends of the wires 13. Each contact 67 includes an open forward end portion 68 for receiving a pin contact 34, and a rearward barrel portion 69 which is crimped to the end of a wire 13 from which the insulation has been stripped. Between the forward portion 68 and the rearward portion 69 is an annular part 70 of increased diameter, which provides a rearwardly facing shoulder 71. The latter element is engageable by the free forward ends of the retention fingers 58, which holds the contact 67 against rearward movement relative to the connector assembly.

Wires 13, with their associated socket contacts 67, may be introduced into all of the openings 56 in the connector assembly, making connections with the pin contacts 34 so as to provide feedbacks through the bus plates 33. The forward ends of the contacts 67 are adjacent the bus plates, thereby positioning the contacts against forward movement.

The socket contacts 67 can be disconnected from the pin contacts 34 by the use of a suitable contact removal tool which spreads the retention fingers 58 apart to allow the shoulder 71 to be free of the fingers and permit the contact to be withdrawn by pulling outwardly on the wire. Such a contact removal tool is shown and described in the aforementioned U.S. Pat. No. 3,727,172.

The wire support 19 is used where a side force may be imposed on the wires 13, but is not required in the absence of such loading. The wire support 19 is of a deflectable plastic and includes a continuous, annular, generally rectangular upper portion 73 which has a lower inside recess 74 along each of its side portions. End walls 75 and 76 extend downwardly from the upper rectangular portion 73 and are provided with central external vertical recesses 77, which are of the same width and depth as the recesses 45 in the end walls 40 and 41 of the housing 17. The corners 79 of the wire support are beveled. At the lower edges of the end walls 75 and 76 are inwardly extending transverse flanges 80. Immediately above the flanges 80, the beveled corners 79 are removed and angled surfaces 81 extend between the inner and outer surfaces of the end walls.

When the wire support 19 is installed, the flanges 80 of its end walls 75 and 76 fit within the transverse grooves 44 in the end walls of the housing 17. This holds the wire support to the housing. In this position, the lower longitudinal edges of the recessed sides 74 of the upper continuous portion 73 of the wire support fit within the longitudinal notches 62 and 63 at the upper corners of the grommet 18 (see FIG. 5). The upper part of the portion 73 of the wire support 19 is above the upper surface of the grommet 18, where it confines and supports the group of wires 13 that enter the connector assembly. The sidewalls 75 and 76 overlie the upper end walls 42 and 43 of the housing 17, and are substantially flush with the lower end walls 40 and 41. Accordingly, the vertical recesses 77 of the wire support form continuations of the vertical recesses 45 in the housing 17.

The modules 10 are positioned in a side-by-side relationship in a single row in the support channel 11 so that their end walls are adjacent the sides 82 and 83 of the channel. The bottom wall 84 of the channel 11 has a central recessed portion 85 extending its full length. Strips of rubber 86, which are rectangular in cross section, are cemented to the central recessed part 85 of the bottom wall 84 and serve as yieldable pads to support the lower surfaces of the modules 10. A series of openings 87 is provided in the center of the bottom wall 84, positioned so that there is one opening 87 beneath each module 10.

The sidewalls 82 and 83 of the channel 11 are locally deformed outwardly to provide spaced pockets 88 and 89, which are parallel to the sidewalls and are open at their tops and bottoms. The pockets 88 and 89 are aligned with the end walls of the modules 10 when the latter are positioned in the support rail 11.

Figure 9:
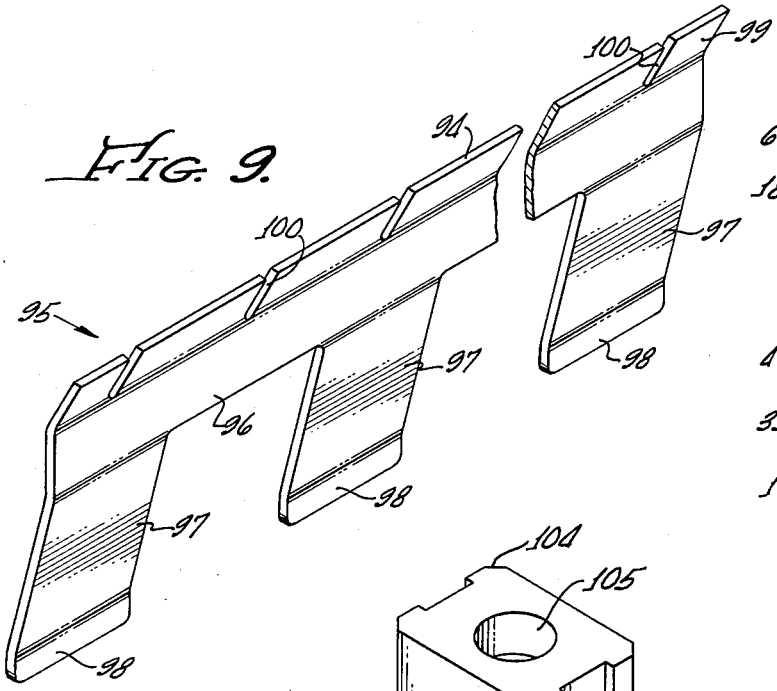
FIG. 9 is an enlarged perspective view of the retention clip for the modules.

At the upper edges of the channel sidewalls 82 and 83 are outwardly projecting longitudinal flanges 90 and 91, the lower edges of which are contoured to define depending shoulders 92 and 93, respectively, adjacent the outer edges of the flanges. The undersurfaces of the flanges are engaged by the upper edge 94 of resilient metal retention clips 95 extending along either side of the support channel 11. The retention clip 95, seen in perspective in FIG. 9, is made of flat sheet metal and includes a continuous longitudinal intermediate part 96 from which depend spaced spring fingers 97. The latter elements incline at a shallow angle from the intermediate part 96 and terminate at lower edge portions 98 which are parallel to the part 96. Above the intermediate part 96 is an upper portion 99 which inclines in a direction opposite that of the lower spaced portions 97. Spaced slots 100 through the upper inclined part 99 extend inwardly from the upper edge 94. These slots impart flexibility to the retention clip 95 to facilitate its installation and removal.

The retention clips 95 are associated with the support channel 11 so that the intermediate longitudinal portions 96 overlie the outer surfaces of the sidewalls above the pockets 88 and 89. The depending spring fingers 97 enter the pockets 88 and 89 and extend downwardly to the interior of the channel. In that location, the flat lower portions 98 fit within the end recesses 45 of the housing 17, bearing against the transverse shoulders 46 at the lower portion of the housing. The upper inclined parts 99 of the retention clips extend outwardly beneath the flanges 90 and 91, with the upper edges 94 bearing against the undersurfaces of these flanges adjacent their shoulders 92 and 93, as previously stated. The retention clips, by bearing against the shoulders 46 of the housing 17, hold the modules 10 firmly against the abutment provided by the support pads 86 on the wall 84 of the channel 11, preventing withdrawal of the modules upwardly out of the channel.

Prior to assembling the modules 10 and the channel 11, the retention clips 95 are positioned along the sides 82 and 83. At this time, the lower edges of the intermediate parts 96 of the retention clips 95 receive support from the upper edges of the pockets 88 and 89.

The modules 10 are inserted into the channel merely by pushing them downwardly by hand without the use of tools. Proper alignment of the modules in the channel 11 is accomplished by spaced vertical beads 101 and 102 in the channel sidewalls 82 and 83, respectively. These beads fit within the spaces provided by the beveled corners of the modules 10, including the bevels 22 of the lower housing 15 and the bevels 48 at the corners of the housing 17, as well as the beveled corners 79 of the wire support 19, to position the modules. The spring fingers 97 of the clips are deflected outwardly by the lower portion of the module 10 at the recessed surfaces 23 and 44 as the module is moved downwardly. When the shoulders 47 are reached, the fingers snap inwardly so that the lower finger ends 98 are above the shoulders to lock the module in place. When the modules 10 are installed, the beads 101 and 102 of the channel hold them in place against forces longitudinally of the channel.

The contacts 67 with their associated wires 13 may be inserted into the modules either before or after the modules are positioned in the channel 11.

Figure 8:
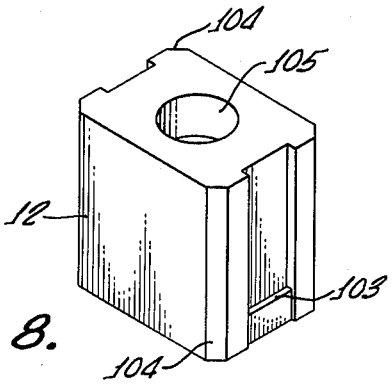
FIG. 8 is a perspective view of one of the end blocks of the connector assembly.
Figure 2:
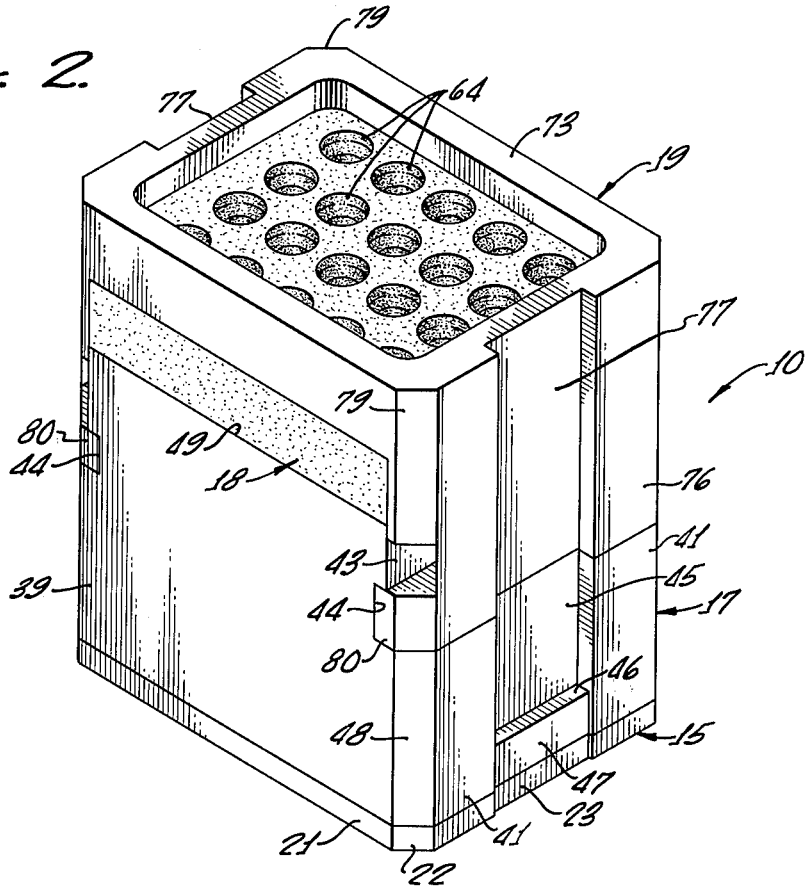
FIG. 2 is a perspective view of one of the modules.

The end blocks 12 are of the same width as the modules 10 and given wall configurations similar to those of the modules, including shoulders 103 which are engaged by the ends 98 of the retainer clips 95 to hold the end blocks within the channel 11. Beveled corners 104 on the end blocks 12 receive portions of the beads 101 and 102 of the channel sidewalls (see FIG. 8). Each end block 12 also has an opening 105 through it which is aligned with one of the openings 87 in the channel 11 when the end blocks is in place. This provides an opening through either end of the connector assembly to receive a mounting screw or bolt used in securing the connector assembly to a supporting structure. By providing openings 87 throughout the length of the channel 11, there will always be an opening 87 aligned with the opening 105 in each end block 12, irrespective of the length to which the channel is cut for accommodating a given number of modules 10.

Figure 11:
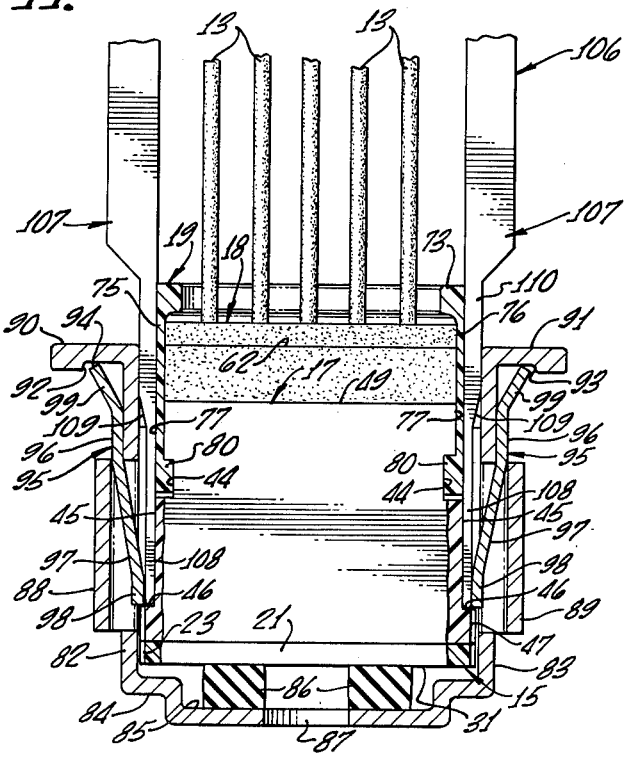
FIG. 11 is a transverse sectional view of the connector assembly, illustrating the release of the retainer clips by the use of the tool of FIG. 10.
Figure 6:
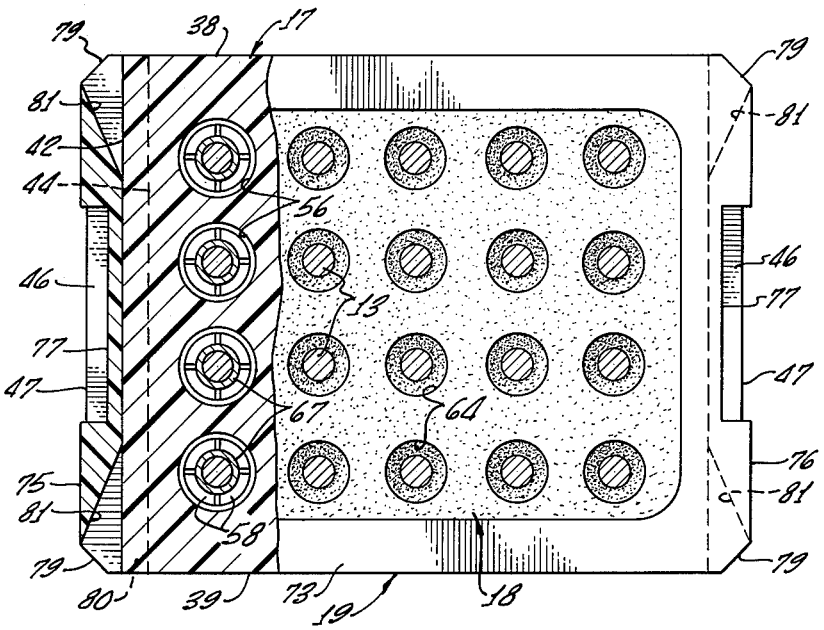
FIG. 6 is a top plan view, partially broken away, of one of the modules.

The modules may be removed from the channel 11 by means of a tool 106, which is in the form of a yoke having parallel legs 107 (see FIG. 10). The outer ends 108 of the legs 107 are relatively thin and connect through tapered surfaces 109 to thicker intermediate parts 110. In removing the module 10, the end of the tool 106 is pressed downwardly within the channel along the recess 77 of the wire support 19 and the recess 45 of the housing 17, as shown in FIG. 11. This causes the end parts 108 of the tool 106 to engage the lower parts of the spring fingers 97 of the retainer clips 95 and move behind the lower ends 98 of the clips, forcing these ends off the shoulders 46 of the housing 17. This frees the module 10 so that, by holding the tool 106 and grasping the wires 13, the module is readily pulled from the channel.

Figure 12:
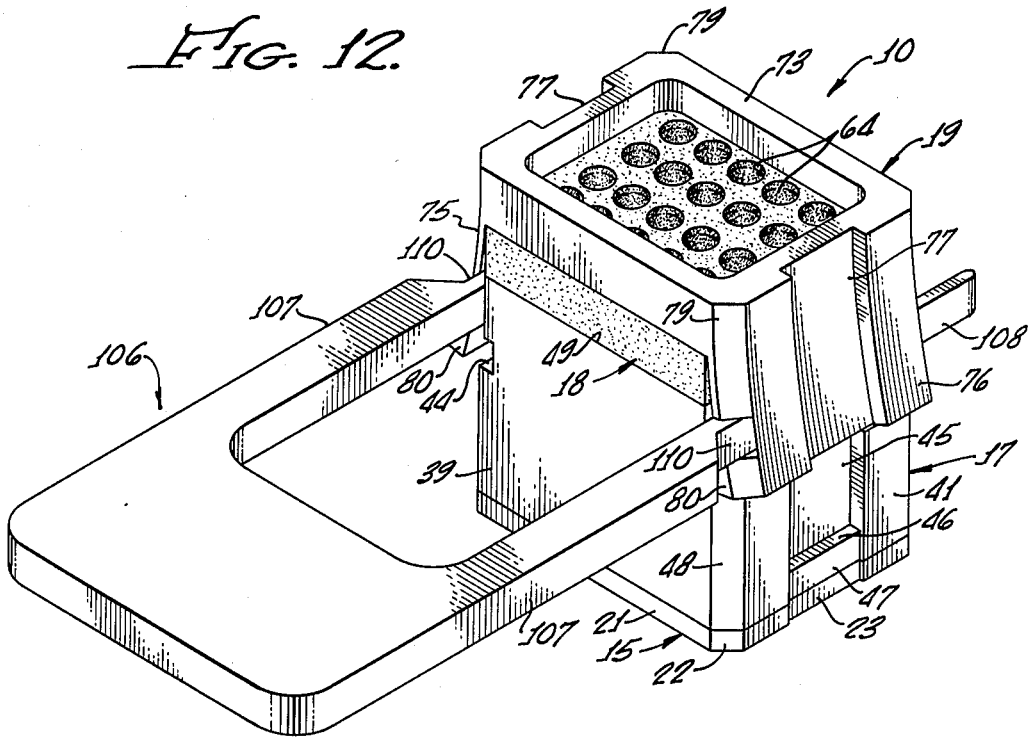
FIG. 12 is a perspective view showing the tool of FIG. 10 used in removal of the wire support.
Figure 4:
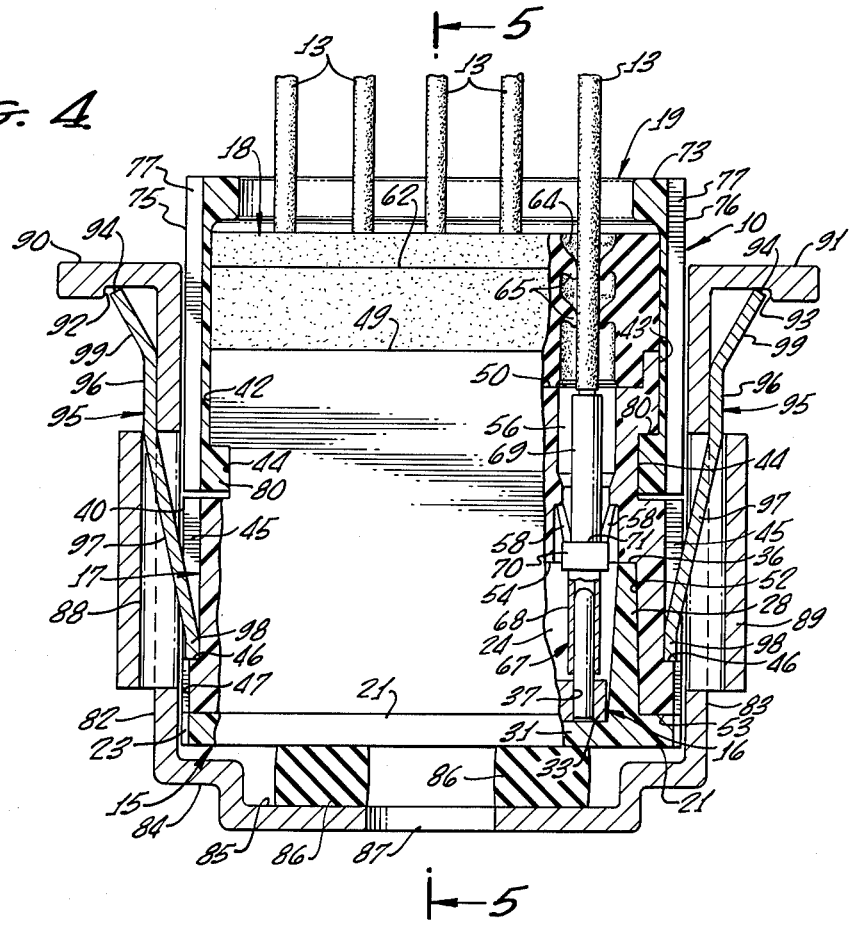
FIG. 4 is an enlarged transverse sectional view taken along line 4—4 of FIG. 1.

The tool 106 likewise is used in removing the wire support 19 from the module. This operation is shown in FIGS. 12 and 13, with the tool being inserted horizontally so as to pry the end walls outwardly and cause the shoulders 80 to disengage the grooves 44 in the end walls of the housing 17. The inclined surfaces 81 immediately above the shoulders 80 of the wire support 19 provide an entrance for the tool so that it can fit between the end walls 75 and 76 of the wire support and the end walls 42 and 43 of the housing 17 to cause the separation. The intermediate portions 110 of the legs of the tool 106 are pushed into operative engagement with the inner surfaces of the end walls 75 and 76 of the wire support 19 to effect sufficient outward deflection of these walls to free the wire support from the housing.

Figure 14:
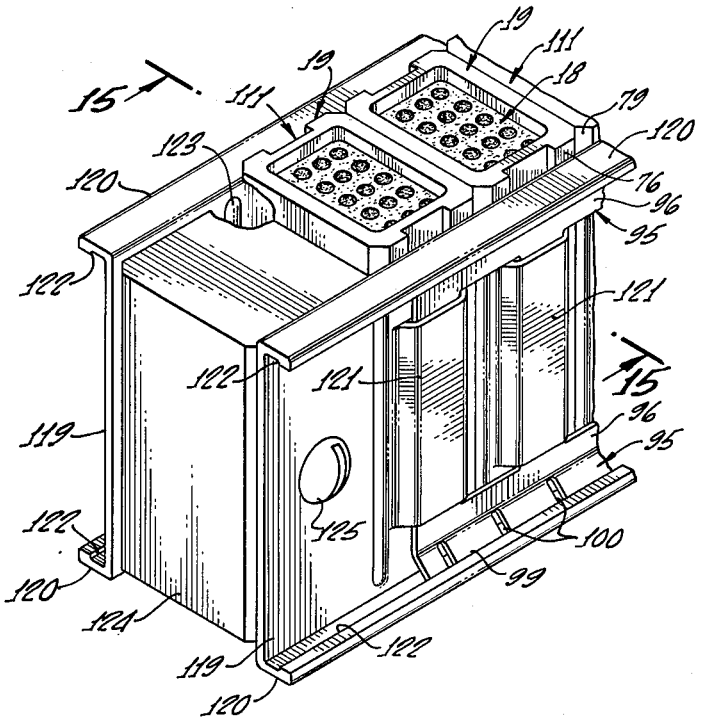
FIG. 14 is a perspective view of the connector assembly modified to provide feedthrough connections.
Figure 15:
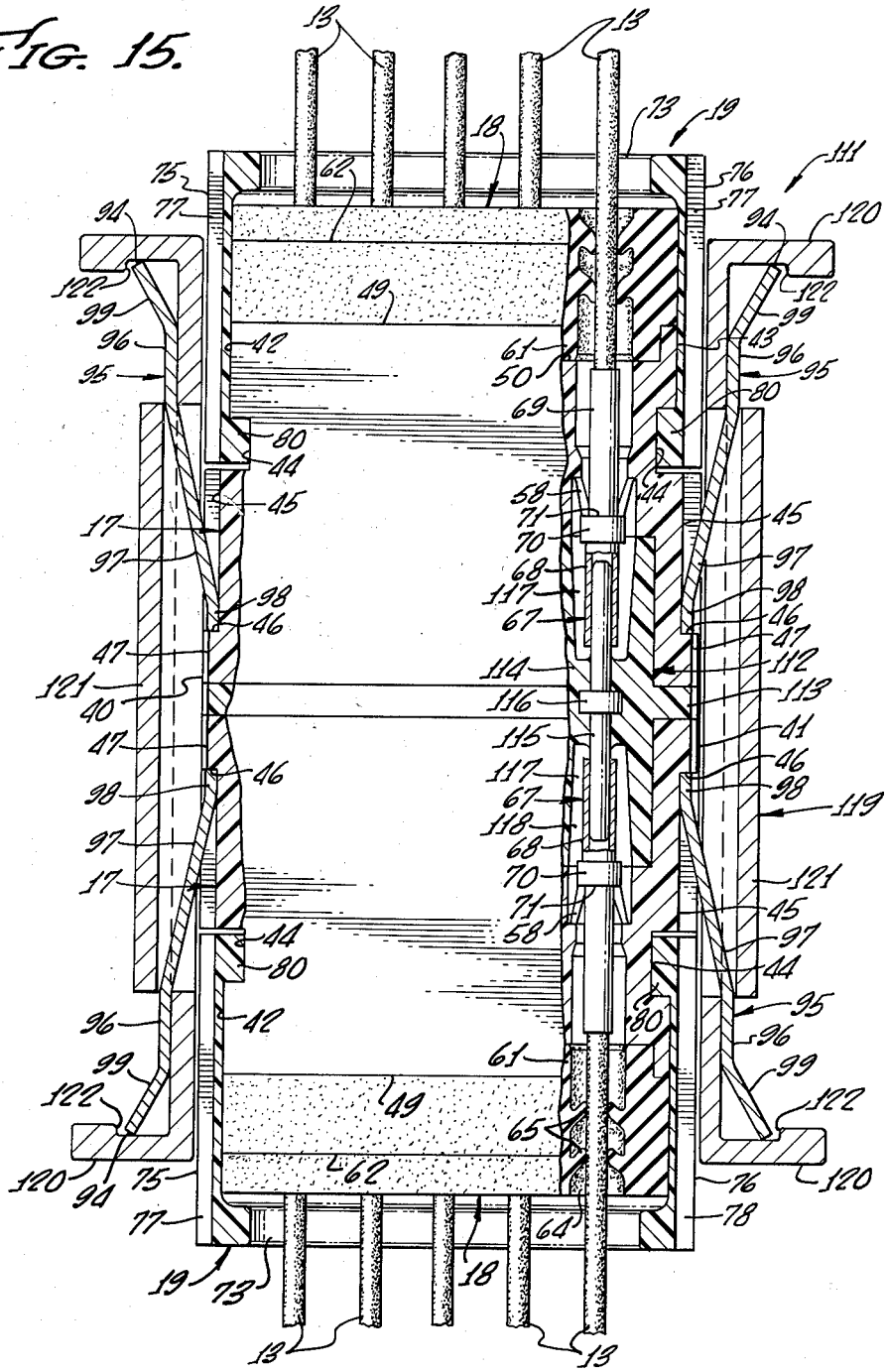
FIG. 15 is an enlarged transverse sectional view of the connector assembly of FIG. 14, taken along line 15—15 of FIG. 14.

Most of the same basic components can be used in variations of the design of FIGS. 1–6. A feedthrough type connector 111 is shown in FIGS. 14 and 15 with the same housing 17, grommet 18, wire support 19 and retention clip 95 used as before. The feedthrough connector utilizes a central housing 112, which is generally similar to a combination of two of the lower housings 15 of the previously described embodiment. The central housing portion 112 includes a laterally projecting flange 113 which fits between the undersurfaces of the two housing portions 17 of the connector. An intermediate transverse wall 114 of the housing 112 receives contact pins 115 which are connected to the housing 112 at that location, such as by annular enlargements 116 on the pins embedded in the wall 114 by sonic welding. The ends of the pins 115 extend into cavities 117 and 118 in the housing 112, which form continuations of the openings 56 in the housings 17. There is but one cavity 117 and 118 for each opening 56 in the adjacent housing 17, so that the walls of these chambers form dielectric barriers between adjacent contacts. The open ends 68 of the socket contacts 67 extend into the chambers 117 and 118 to engage the two ends of the pin contacts 115. This forms a connection between aligned wires 13.

The feedthrough connector 111 of FIGS. 14 and 15 is mounted between a pair of flat rails 119, each of which has a pair of flanges 120 which correspond to the flanges 90 and 91 of the channel 11. Retention clips 95 extend into opposite ends of pockets 121 in the walls of the rails 119, the pockets 121 being similar to the pockets 88 and 89 of the channel 11 except that they are longer. The opposite edges 94 of the retention clips 95 fit beneath the flanges 120 and inwardly of their shoulders 122. Beads 123 on the inside surfaces of the rails 119 fit within the beveled corners of the modules 111, positioning them longitudinally of the rails.

The modules 111 are inserted into one side of the rails 119 by hand, and advanced inwardly until the ends 98 of the retention fingers 97 are reached by the shoulders 46. This means that the pair of shoulders 46 on one side of the module 111 is moved directly toward one set of the finger ends 98, while the shoulders 46 on the other side of the module move past the ends 98 of the other fingers in a way similar to that of the modules 10 when inserted in the channel 11.

End blocks 124 are included at the opposite ends of the rails 119 to close off the ends of the series of feedthrough connectors 111, also holding the rails 119 properly spaced apart. Bolts 125, extending through the walls of the rails 119 and the blocks 124, secure the rails 119 together.

Figure 16:
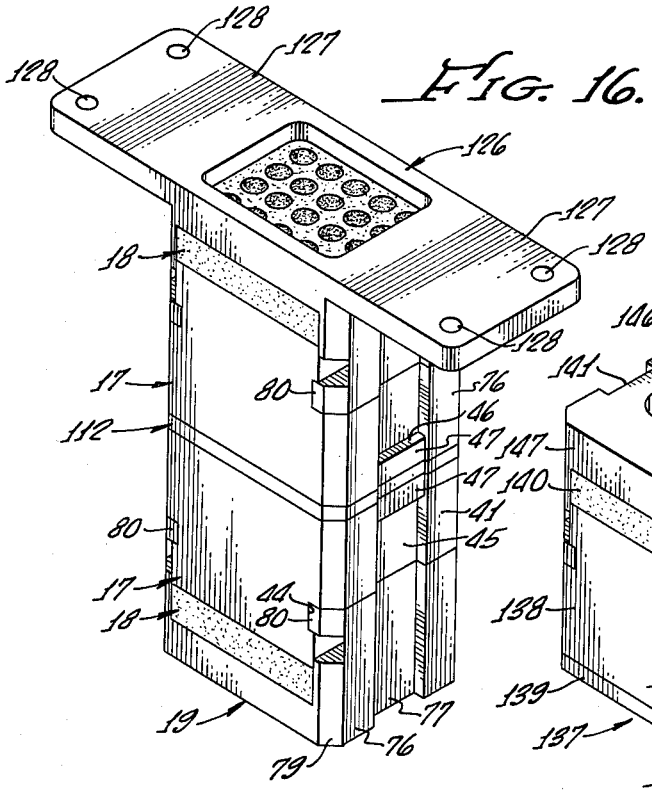
FIG. 16 is a perspective view of a modified form of the feedthrough connector having a mounting flange.

FIG. 16 illustrates how the module may be adapted for flange mounting. In this construction, there is a wire support 19 at one end of the connector, while the other wire support 126 at the opposite end has a flange 127 which projects outwardly from the continuous outer end portion of the wire support. Openings 128 in the flange 127 are adapted to receive fasteners for securing the module to a mounting structure (not shown). The engagement of the shoulders 80 of the wire support having the flange 127 with the grooves 44 in the housing 17 serves to hold the module to the mounting structure by means of the flange 127.

Figure 18:
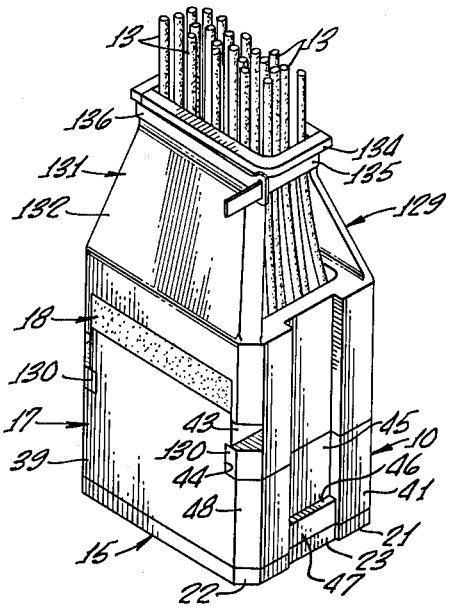
FIG. 18 is a view similar to FIG. 17, with the wire clamp closed.
Figure 17:
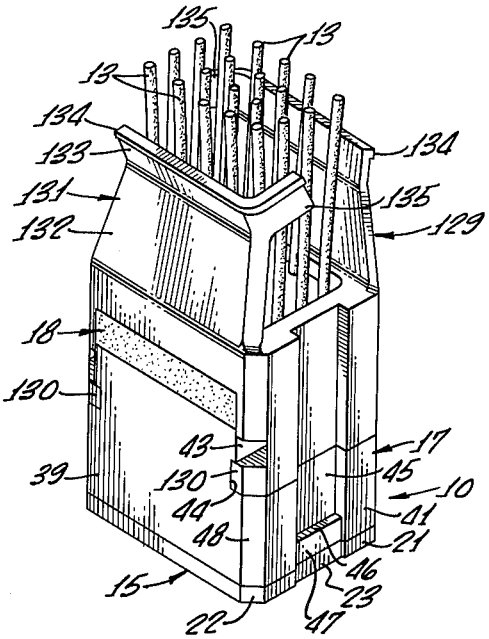
FIG. 17 is a perspective view of a module utilizing a wire clamp as a support for the wires, with the clamp in the open position.

In lieu of the wire support 19, a wire clamp 129 may be used, as shown in FIGS. 17 and 18. The wire clamp 129 is similar to the wire support 19 by including shoulders 130 to fit within the groove 44 in each of the end walls of the housing 17. At the opposite end of the clamp 129 are bendable walls 131 which have inwardly inclined lower portions 132 and straight outer parts 133 having end flanges 134. There is a short, narrow end wall 135 at one end of each of the walls 131, the two end walls 135 being at opposite ends of the clamp. A metal strap 136 is used to hold the walls 131 around the wires 13 of the module 10. The strap 136 draws the walls 131 inwardly where their straight sections 133 engage the outer wires of the bundle, and the end walls 135 extend around the ends of the bundle to overlap the adjacent walls 131.

The capacity of the module 10 may be varied without altering its exterior configuration so that in all events it will be compatible with the support channel 11 when made as a feedback connector or will fit within the rails 119 when constructed as a feedthrough. In other words, the modules can be made in interchangeable styles that will accept different sizes of contacts. The embodiment of the module 10 illustrated has contact cavities 56 and is for size 22 contacts. A module of the same exterior dimensions for size 20 contacts may be provided with twelve interior cavities. Six cavities are included in a module which will accommodate size 16 contacts.

Figure 19:
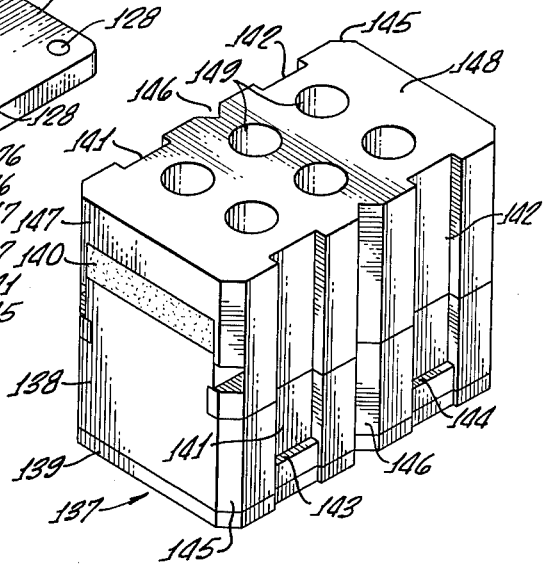
FIG. 19 is a perspective view of a modified module used for larger sized contacts.

For the still larger size 12 cotacts, the module may be made with six cavities and, in effect, doubled in size, but nevertheless contoured to fit within the same mounting as that for the module 10. As shown in FIG. 19, the module 137 is twice the width of the module 10, being made up of a principal dielectric housing 138, a lower housing 139 and a grommet 140, each of which is twice as wide as the corresponding element of the module 10. The module 137 includes two vertical recesses 141 and 142 in each end wall, these recesses extending downwardly to horizontal retention shoulders 143 and 144, respectively. The recesses 141 and 142 are spaced apart a distance equal to the spacing between the vertical recesses 45 in two of the modules 10 placed in a side-by-side relationship in the support channel 11. The module 137 has beveled corners 145 and a central vertical V-shaped groove 146 in each end wall for receiving the beads 101 and 102 of the channel sidewalls, aligning the module and retaining it longitudinally of the channel.

Consequently, the single module 137 will replace two of the modules 10 in the support channel 11, and will be retained by two of the retention fingers 97 on either side. Otherwise, it is associated with the channel 11 in the same manner as that of the module 10. Removal of the module 137 is accomplished by use of two of the tools 106, each of which pries a pair of the retention fingers 97 outwardly from the shoulders on opposite sides of the module. Alternatively, the removal tool may be made with four prongs instead of two.

The wire support 147 used with the module 137 similarly is made twice as wide as the wire support 19. For additional reinforcement, it may include a transverse upper wall 148 extending over the upper surface of the module, but having six openings 149 for receiving the wires that enter the module.

The feedthrough for the larger size contacts may be made twice the dimension of the feedthrough connector of FIGS. 14 and 15 in a way similar to that of the module 137.

The foregoing detailed description is to be clearly understood as given by way of illustration and example only, the spirit and scope of this invention being limited solely by the appended claims.

We claim:

1. An electrical connector arrangement comprising
a plurality of modules,
and a support for said modules,
each of said modules including a body of dielectric material,
said body having a plurality of openings therein,
an electrical circuit means in each of said openings including
a duality of socket contacts in each of said openings,
a wire connected to each of said socket contacts, and a pin contact in each of said openings having opposite ends received in said socket contacts for forming an electrical connection therebetween,
said support including a duality of elongated substantially flat members defining opposed spaced walls,
said modules being positioned between said walls in a side-by-side relationship so as to form a row of said modules, and having opposite outer surfaces adjacent said walls,
each of said surfaces having a duality of abutments,
said support including
at least four resilient opposed retention members for each of said modules,
each of said retention members being inclined inwardly toward an adjacent module and having an outer end engaging one of said abutments thereof for retaining said modules to said support,
two of said retention members being inclined inwardly in one direction for engaging two of said abutments, two of said retention members being inclined inwardly in the opposite direction for engaging the other two of said abutments.
each of said elongated substantially flat members having an outwardly projecting flange along either side edge thereof, said flanges having shoulders thereon,
said retention members having edges engaging said flanges adjacent said shoulders for holding said retention members to said elongated substantially flat members,
and a member at either end of said row of said modules interconnecting said elongated substantially flat members.

2. An electrical connector device comprising
a plurality of modules,
each of said modules including
a housing of dielectric material having a plurality of openings therein,
a socket contact in each of said openings, means for retaining said socket contacts in said openings,
and pin contacts in said housing received in said socket contacts,
each of said modules having exterior shoulder means thereon, said modules being in a side-by-side relationship,
a support means for said modules
said support means including a member having opposed
sidewalls having openings therein,
said modules being received between said sidewalls,
and retainer means for releasably retaining said modules on said support means,
said retainer means including a resilient
retention member engaging said shoulder
means of each of said modules, said retention members extending from the exterior of said sidewalls through said openings to engage said shoulder means.

3. A device as recited in claim 2 in which
said retainer means includes an elongated member having a plurality of spaced laterally projecting portions defining said retention members,
said elongated member being on the outside of said sidewalls,
and said support member includes abutments engaged by said elongated member for holding said retention members against said shoulder means.

4. A device as recited in claim 3 in which, for said openings,
said sidewall is provided with integral portions deflected outwardly so as to be substantially parallel with said sidewalls and open at the top and bottom portions thereof.

5. An electrical connector arrangement comprising
a support means, said support means including
a substantially U-shaped channel having sides defining opposed walls,
a transverse abutment intermediate said opposed walls,
opposed resilient retention members inclined from said opposed walls toward each other and toward said abutment and terminating in free outer ends,
each of said retention members being formed from a flat strip of resilient sheet metal,
and outwardly extending flange at the distal end of each of said opposed walls,
each of said flanges defining a shoulder on the undersurface thereof,
said retention members having ends engaging said flanges adjacent said shoulders for holding said retention members to said opposed walls,
a plurality of electrical connector modules arranged in a side-by-side relationship in said channel, each of said modules including
a body of dielectric material,
said body having at least one opening therein,
and electrical circuit means in said opening including
a socket contact, a wire connected to said socket contact, and a pin contact received in said socket contact for forming an electrical connection thereto, said body having a surface adjacent said abutment for limiting movement of said body in one direction relative to said support means, said body having a duality of shoulders each of which is engageable by said free end of one of said resilient retention members for limiting movement of said body in the opposite direction relative to said support means.

6. A device as recited in claim 5 in which said opposed walls have openings therethrough receiving said retention members, said retention members for said modules on either side of said support means being interconnected by an elongated strip positioned on the exterior of the adjacent one of said opposed walls.

7. A device as recited in claim 6 in which, for defining said openings in said opposed walls, each of said walls is provided with a plurality of outwardly deflected portions each of which has an upper edge defining an opening, said elongated strips being adjacent said upper edges of said outwardly deflected portions, whereby said upper edges provide a support for said retention members.

8. A device as recited in claim 6 in which said elongated strip includes an outwardly inclined portion, said outwardly inclined portion defining said ends of said retention members engaging said flanges, said elongated strip having a second portion complementarily overlying the adjacent one of said opposed walls.

9. A device as recited in claim 8 in which said outwardly inclined portion is provided with notches extending inwardly from the outer edge thereof for imparting flexibility to said elongated strip.

10. An electrical connector arrangement comprising a support means, said support means including a substantially U-shaped channel having sides defining opposed walls, and an intermediate wall interconnecting said sides, a transverse abutment intermediate said opposed walls, and opposed resilient retention members inclined from said opposed walls toward each other and toward said abutment and terminating in free outer ends, and a plurality of electrical connector modules arranged in a side-by-side relationship in said channel, each of said modules including a body of dielectric material, said body having at least one opening therein, electrical circuit means in said opening including a socket contact, a wire connected to said socket contact, and a pin contact received in said socket contact for forming an electrical connection thereto, said body having a surface adjacent said abutment for limiting movement of said body in one direction relative to said support means, said body having a duality of shoulders each of which is engageable by said free end of one said resilient retention members for limiting movement of said body in the opposite direction relative to said support means, said body having opposite outer walls, each of said walls having a transverse groove therein, and at least one wire support, said wire support having a pair of opposed walls, each of which includes a transverse flange on the lower end portion thereof, said opposed walls of said wire support overlying said outer walls of one of said bodies, said transverse flanges being received in said grooves for retaining said support means to said one body, said wire support having a portion at the upper ends of said opposed walls encircling said wires adjacent one end of said one body, each of said opposed walls of said wire support including an outer surface, an inner surface overlying one of said outer walls of said one body, and an inwardly inclined surface interconnecting said inner and outer surfaces at one edge portion thereof adjacent and above said flange for providing an entrance for a tool for deflecting said opposed wall of said support means so as to remove said flange thereof from said transverse groove receiving the same so as to permit removal of said wire support.

* * * * *